US010111536B2

(12) United States Patent
Bezuidenhout et al.

(10) Patent No.: US 10,111,536 B2
(45) Date of Patent: Oct. 30, 2018

(54) TRAVEL CHANGER SYSTEM

(71) Applicants: Sherrie Bezuidenhout, Anthem, AZ (US); Summer Adkins, Anthem, AZ (US)

(72) Inventors: Sherrie Bezuidenhout, Anthem, AZ (US); Summer Adkins, Anthem, AZ (US)

( * ) Notice: Subject to any disclaimer, the term of this patent is extended or adjusted under 35 U.S.C. 154(b) by 0 days.

(21) Appl. No.: 15/792,752

(22) Filed: Oct. 25, 2017

(65) Prior Publication Data

US 2018/0168363 A1 Jun. 21, 2018

Related U.S. Application Data

(60) Provisional application No. 62/437,484, filed on Dec. 21, 2016.

(51) Int. Cl.

| | |
|---|---|
| ***A47D 5/00*** | (2006.01) |
| ***A47D 15/00*** | (2006.01) |
| ***A47B 3/08*** | (2006.01) |
| ***A47D 7/00*** | (2006.01) |
| ***A47C 17/64*** | (2006.01) |

(52) U.S. Cl.

CPC ..... *A47D 5/006* (2013.01); *A47B 3/08* (2013.01); *A47C 17/64* (2013.01); *A47D 7/002* (2013.01); *A47D 15/008* (2013.01)

(58) Field of Classification Search

CPC ..... A47C 17/64; A47C 17/66; A47D 7/002; A47D 9/005

USPC ..... 108/115; 5/113, 116, 112, 114, 497, 655, 5/503.1

See application file for complete search history.

(56) References Cited

U.S. PATENT DOCUMENTS

| | | | | | |
|---|---|---|---|---|---|
| 2,460,308 | A * | 2/1949 | Pribil | A47D 13/107 | 297/295 |
| 3,462,773 | A | 8/1969 | Triplett | | |
| 3,561,772 | A * | 2/1971 | Curtess | A63B 23/03575 | 297/316 |
| 4,012,800 | A * | 3/1977 | Mitchell | A23B 7/148 | 5/187 |
| 4,846,204 | A * | 7/1989 | Sok Kyu | E04H 15/324 | 135/145 |
| 5,109,556 | A * | 5/1992 | Cook | A47C 19/005 | 5/110 |
| 5,722,100 | A * | 3/1998 | Jozwiak | A47D 15/008 | 4/572.1 |
| 6,079,338 | A * | 6/2000 | Yeh | A47B 13/12 | 108/115 |

(Continued)

*Primary Examiner* — Jose V Chen

(74) *Attorney, Agent, or Firm* — Integrity Patent Group, PLC; Edwin Wold

(57) ABSTRACT

A travel changer system includes a baby changing surface while on-the-go. The travel changer system includes a folding frame including a pair of support cross beams having a first end and a second end, a first-changing surface support beam, and a second-changing surface support beam, a changing surface, and safety belt having a fastener. The folding frame may be formed of foldable lightweight material allowing the device to be folded and stored easily to increase portability while on-the-go. The changing surface is comprised of a canvas or otherwise suitable cloth to allow for reduced weight and easy cleaning. When unfolded into its upright position the changing surface is approximately thigh-height and offers safety and cleanliness.

20 Claims, 5 Drawing Sheets

(56) References Cited

U.S. PATENT DOCUMENTS

| | | | | |
|---|---|---|---|---|
| 6,134,727 | A * | 10/2000 | Hwang | A47C 17/64 5/110 |
| 6,378,445 | B1 * | 4/2002 | Willard, Sr. | A47B 3/08 108/115 |
| 6,389,624 | B1 | 5/2002 | Madole | |
| 6,581,228 | B1 | 6/2003 | Boskovich | |
| 6,647,560 | B1 * | 11/2003 | Hingley | A47K 11/04 297/16.2 |
| 7,509,695 | B2 * | 3/2009 | Zheng | A47C 17/68 273/108 |
| 7,681,267 | B1 | 3/2010 | Hall | |
| 7,698,756 | B1 * | 4/2010 | Chen | A47C 17/72 135/96 |
| 7,712,163 | B2 * | 5/2010 | Flannery | A47C 17/72 5/110 |
| 7,770,246 | B2 * | 8/2010 | Chen | A47C 19/126 5/111 |
| 2003/0233966 | A1 * | 12/2003 | Zheng | A47B 3/02 108/115 |
| 2004/0104189 | A1 * | 6/2004 | Yu | A47B 3/002 211/195 |
| 2006/0174415 | A1 | 8/2006 | Moulton | |
| 2015/0327689 | A1 * | 11/2015 | Howard | A47D 5/00 5/655 |

* cited by examiner

TRAVEL CHANGER SYSTEM

CROSS REFERENCE TO RELATED APPLICATION

The present application is related to and claims priority to U.S. Provisional Patent Application No. 62/437,484 filed Dec. 21, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of baby changing tables and more specifically relates to a travel changer system.

2. Description of Related Art

There are many times when a baby needs to have their diaper changed while on the go. Without a public changing table available, many parents and caretakers resort to changing diapers on the ground or on the seat of a car. In addition, public changing tables are commonly exposed to bacteria and germs that many parents would like to avoid. However, it can be difficult to find alternative locations for a diaper change. A baby changing table is a small raised platform designed to allow a person to change an infant/toddler's diaper, and it is often part of a nursery set. The topmost surface is used to rest the infant/toddler being changed, during the changing process. Many public restrooms have public baby changing tables available should a diaper change be required in a public place. A suitable solution is desired allowing for remote diaper changes.

U.S. Pat. No. 7,681,267 to Carmelina Hall relates to a collapsible and portable baby changing table. The described collapsible and portable baby changing table includes a collapsible and portable baby changing table having a folding frame and a changing surface. The folding frame has two sets of opposing sides. Each side has at least one pair of crossing support beams. The pair of crossing support beams is hinged where the crossing support beams cross. The crossing support beams have top ends and bottom ends. The folding frame is configured to be folded to a first position and unfolded to a second position. The changing surface is supported by the folding frame. When the folding frame is unfolded to the second position, the changing surface is contoured to cradle a baby's body when the baby is placed on the changing surface.

BRIEF SUMMARY OF THE INVENTION

In view of the foregoing disadvantages inherent in the known baby changing tables art, the present disclosure provides a novel portable folding travel changer system. The general purpose of the present disclosure, which will be described subsequently in greater detail, is to provide a portable baby changing table for use in restrooms, outdoors or other areas where there is no suitable baby changing surface available.

A travel changer system is disclosed herein. The travel changer system includes a folding frame including a pair of support cross beams having a first end and a second end, a first-changing surface support beam, and a second-changing surface support beam, a changing surface, and a safety belt having a fastener. The travel changer system comprises the folding frame, the changing surface, and the safety belt in functional combination. The folding frame is defined by the pair of support cross beams, the first-changing surface support beam, and the second-changing surface support beam. The first end of the pair of support cross beams engage the first-changing surface support beam and the second-changing surface support beam. The second end of the pair of support cross beams is in contact with a planar surface during use. The folding frame is configured to support the baby at a thigh height of a user during changing and collapse for storing. The device is designed to be extremely compact and portable.

A kit is also disclosed herein including a folding frame, a changing surface, and a carrying case.

A method of using the travel changer system is disclosed herein. The method of using a travel changer system includes unfolding a folding frame, placing a baby on a changing surface coupled to the folding frame, securing the baby to the changing surface using fastener located on a safety belt, and changing the baby, collapsing the folding frame, and storing the folding frame and the changing surface.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a travel changer system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to baby changing tables and more particularly to a travel changer system as used to improve the travel changer system.

Generally, a travel changer system is disclosed which may be used in restrooms, outdoors or other areas where there are no baby changing surfaces available. The folding frame may be formed of foldable lightweight aluminum (or other suitably equivalent material) allowing the device to be folded and stored easily to increase portability while on-the-go. The frame further features safety brackets designed to hold the folding frame in an upright position until a user is finished with the changing surface. The changing surface is comprised of a canvas or otherwise suitable cloth to allow for reduced weight and easy cleaning. The changing surface may be a water-resistant, weather-resistant fabric surface for easily cleaning and wiping down. When unfolded into its upright position the changing surface is approximately thigh-height (on the average user) and offers safety and cleanliness unmatched by public baby changing surfaces. The present invention includes a light weight folding travel changer system used for parents and caregiver on the go while away from home. The device is suitable for parks, airports, and camping and provides a replacement for using a seat of a car, bed of a truck, or unclean public changer.

Figure 1:
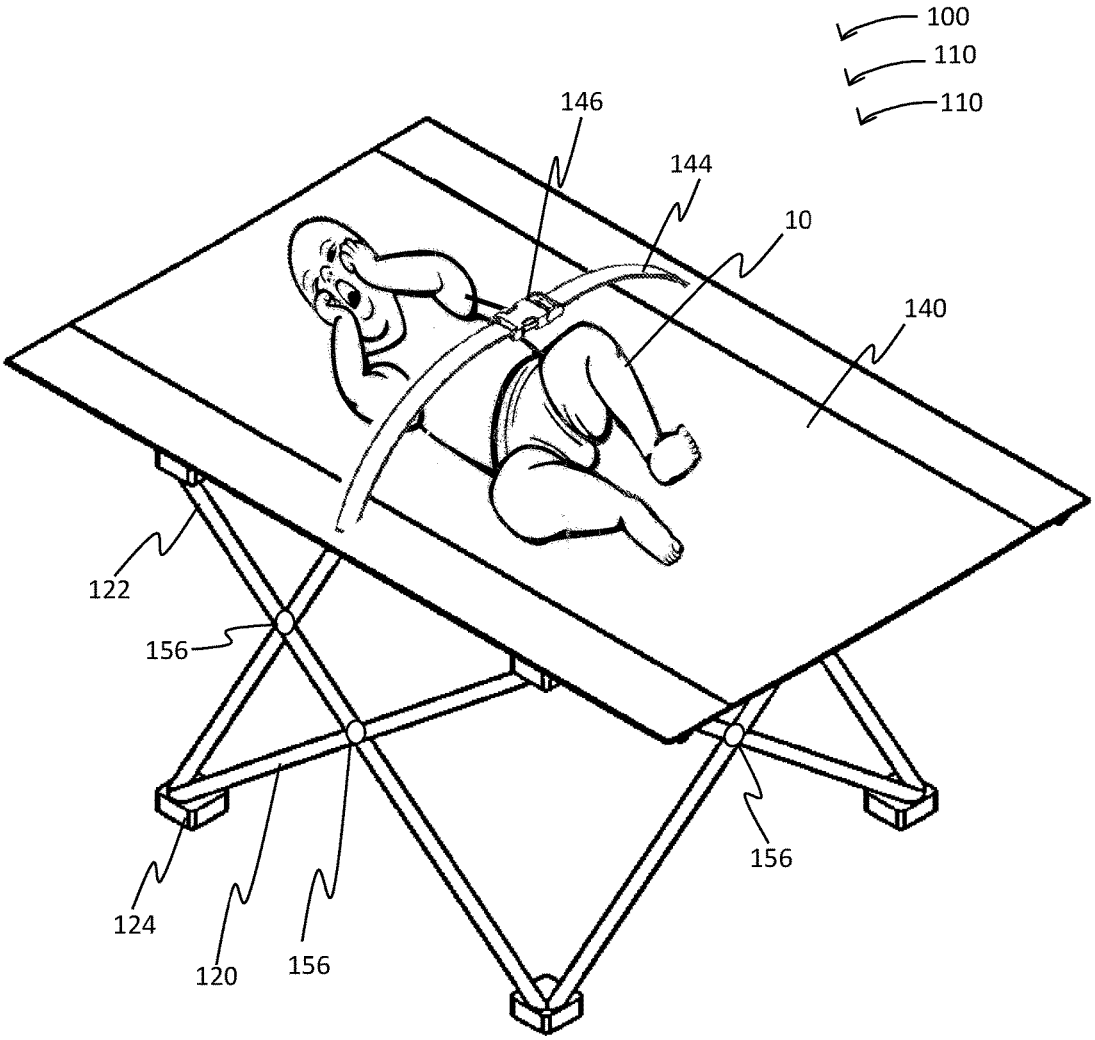
FIG. 1 is a front perspective view of the travel changer system during an 'in-use' condition, according to an embodiment of the disclosure.

Referring now more specifically to the drawings by numerals of reference, there is shown in FIGS. 1-4, various views of a travel changer system 100. FIG. 1 shows a travel changer system 100 during an 'in-use' condition 150, according to an embodiment of the present disclosure. As illustrated, the travel changer system 100 may include a folding frame 110 including a pair of support cross beams 120 having a first end 122 and a second end 124, a first-changing surface support beam 130, and a second-changing surface support beam 134, a changing surface 140, and a safety belt 144 having a fastener 146.

The travel changer system 100 comprises the folding frame 110, the changing surface 140, and the safety belt 144 in functional combination. The folding frame 110 is defined by the pair of support cross beams 120, the first-changing surface support beam 130, and the second-changing surface support beam 134. The first end 122 of the pair of support cross beams 120 engage the first-changing surface support beam 130 and the second-changing surface support beam 134. The second end 124 of the pair of support cross beams 120 is in contact with a planar surface during use. The folding frame 110 is configured to support a baby 10 at a thigh height of a user during changing and collapse for storing.

Figure 2:
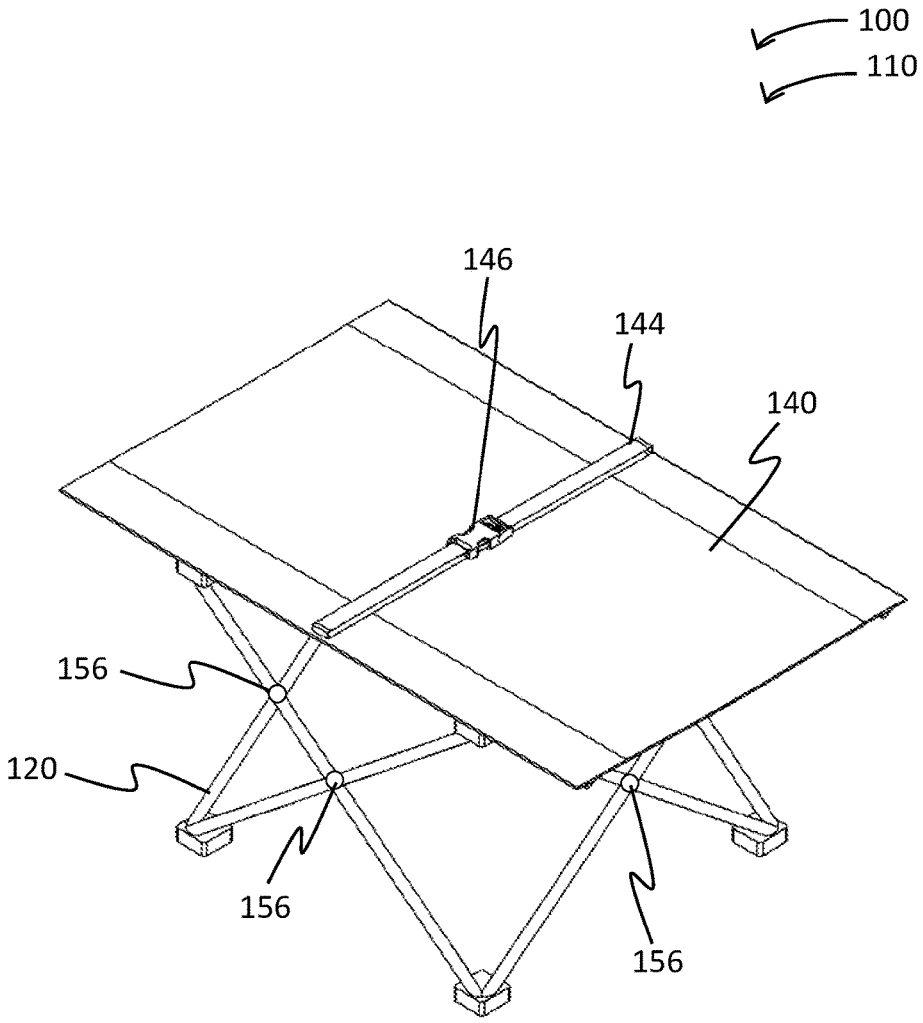
FIG. 2 is a perspective view of the travel changer system of FIG. 1, according to an embodiment of the present disclosure.

FIG. 2 shows a perspective view of the travel changer system 100 of FIG. 1, according to an embodiment of the present disclosure. As above, the travel changer system 100 may include the folding frame 110 including the pair of support cross beams 120 having the first end 122 and the second end 124, the first-changing surface support beam 130, and the second-changing surface support beam 134, the changing surface 140, and the safety belt 144 having the fastener 146. The changing surface 140 comprises a sleeve 158 on each opposing side for coupling the changing surface 140 to the first-changing surface support beam 130 and second-changing surface support beam 134. The first-changing surface support beam 130 and the second-changing surface support beam 134 are parallel to one another on opposing sides of the changing surface within the sleeve 158.

Figure 3:
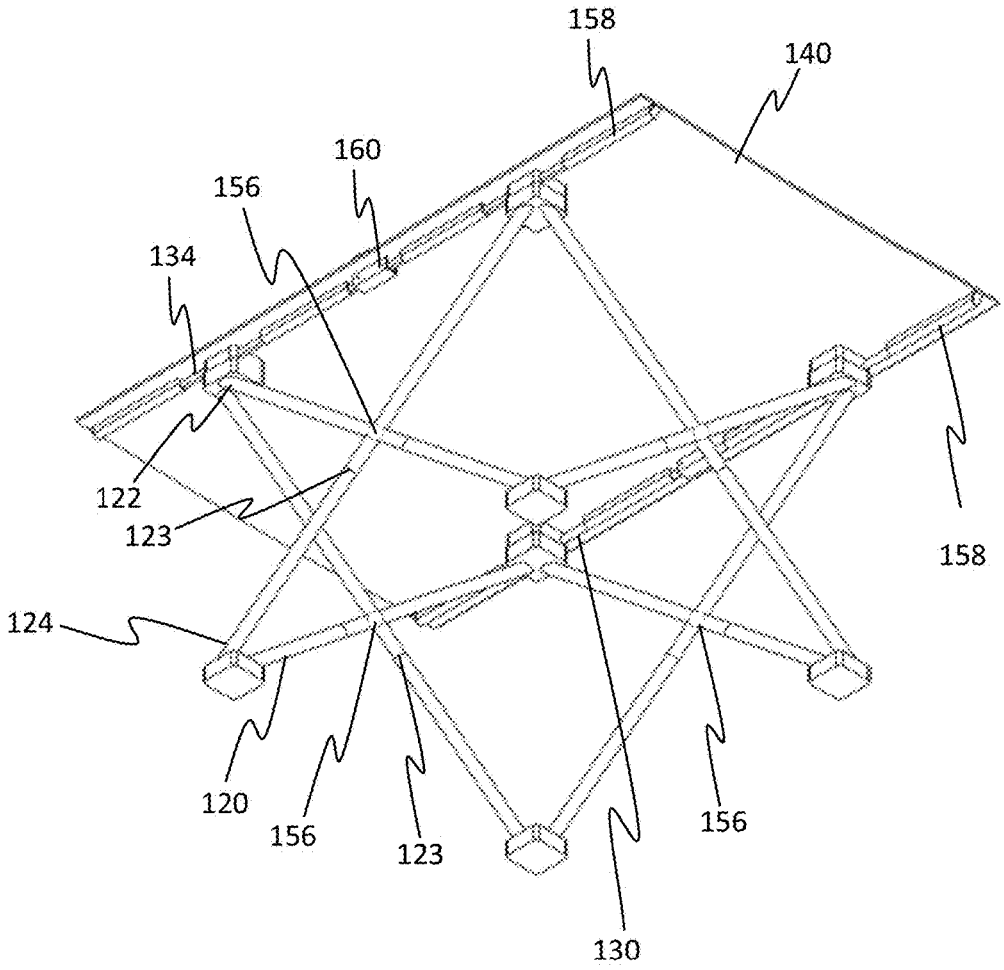
FIG. 3 is a perspective view of the travel changer system of FIG. 1, according to an embodiment of the present disclosure.

The pair of support cross beams 120 are located under the changing surface 140 when configured to use. The pair of support cross beams 120 comprise hinge members 156 and are configured in an x-shape for folding and unfolding repeatedly as desired at the hinge member 156. The pair of support cross beams 120 comprise the hinge members 156 in a middle section for folding. The hinge member 156 comprises a cross-beam pivoting hinge. The cross-beam pivoting hinge is configured to allow the pair of support cross beams 120 to move in relation to one another from a folded configuration to the in-use condition. The first end 122 of the pair of support cross beams 120 are disposed inset to four corners of the changing surface 140. The pair of support cross beams 120 are positioned at opposing corners of the changing surface 140. The pair of support cross beams 120 are inset from an outer perimeter of the changing surface 140. The pair of support cross beams 120 may be telescopic. The telescopic joint 123 in support beams 120 is shown in FIG. 3. The telescopic joint 123 locks or holds support beam 120 when support beam 120 is telescoped out. The first-changing surface support beam 130 and the second-changing surface support beam 134 further support the outer perimeter of the changing surface 140. The device may further include locks for stabilizing the device and providing additional safety.

The first-changing surface support beam 130 and second-changing surface support beam 134 are rigid and comprise a folding member 160. The pair of support cross beams 120 comprise a height approximately equal to the thigh height of the user in an extended position. The device is designed to be extremely compact and portable.

FIG. 3 shows a perspective view of the travel changer system 100 of FIG. 1, according to an embodiment of the present disclosure. As above, the travel changer system 100 may include the folding frame 110 having the pair of support cross beams 120 including the first end 122 and the second end 124, the first-changing surface support beam 130, and the second-changing surface support beam 134, the changing surface 140, and the safety belt 144 having the fastener 146. The first-changing surface support beam 130 and the second-changing surface support beam 134 are parallel and proximal to the outer perimeter of the changing surface 140 further supporting a portion not directly supported by the support cross beams 120. The first-changing surface support beam 130 and second-changing surface support beam 134 are also collapsible when not in use. During use, the first-changing surface support beam 130 and second-changing surface support beam 134 are rigid and locked into an extended position.

The safety belt 144 comprises the fastener 146 which is configured to secure a baby 10 upon a top surface of the changing surface 140 when used. The fastener 146 comprises a buckle-strap-fastener or other suitable fastener. The buckle-strap-fastener comprises a quick release clasp and a strap clip fastener.

Figure 4:
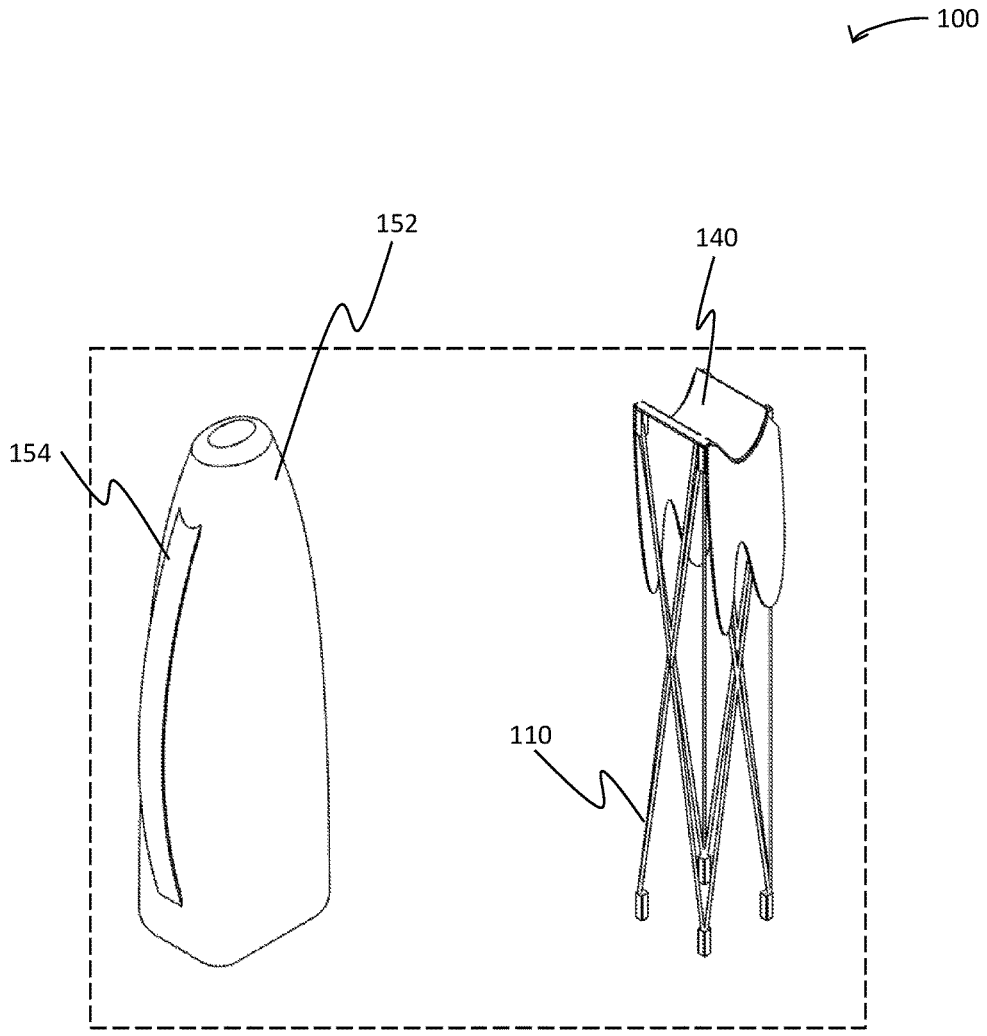
FIG. 4 is a perspective view of the travel changer system of FIG. 1, according to an embodiment of the present disclosure.

FIG. 4 shows a perspective view of the travel changer system 100 of FIG. 1, according to an embodiment of the present disclosure in a collapsed condition. As above, the travel changer system 100 may include the folding frame 110 including the pair of support cross beams 120 having the first end 122 and the second end 124, the first-changing surface support beam 130, and the second-changing surface support beam 134, the changing surface 140, and the safety belt 144 having the fastener 146. The first-changing surface support beam 130 and second-changing surface support beam 134 are also collapsible when not in use. The folding frame 110 and the changing surface 140 are configured to support a baby 10 in an elevated position, the baby 10 or child weighing up to 30 pounds. The travel changer system 100 further comprises a carrying case 152 having a carry-handle 154. The changing surface 140 may have a substantially rectangular body comprising a flexible cloth canvas material or other suitable material.

Figure 5:
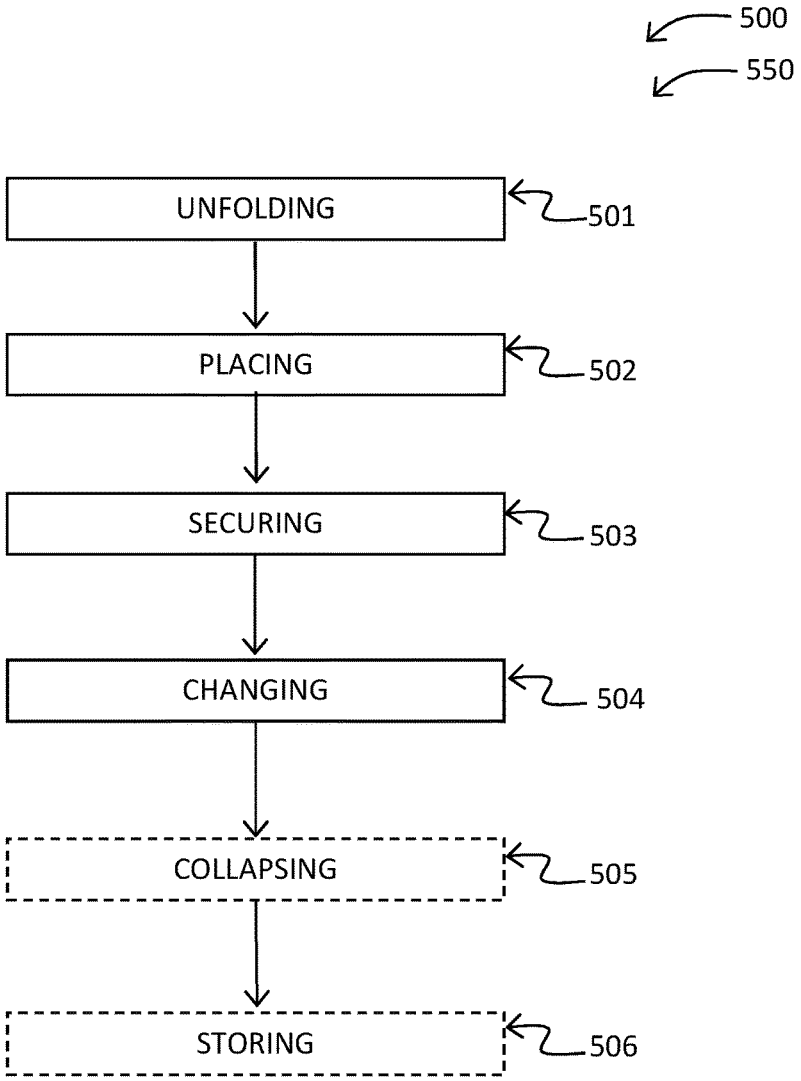
FIG. 5 is a flow diagram illustrating a method of use for the travel changer system, according to an embodiment of the present disclosure.

FIG. 5 is a flow diagram 550 illustrating a method of using 500 a travel changer system 100, according to an embodiment of the present disclosure. In particular, the method of using 500 a travel changer system 100 may include one or more components or features of the travel changer system 100 as described above. As illustrated, the method of using 500 a travel changer system 100 may include the steps of: step one 501, unfolding a folding frame 110; step two 502, placing a baby 10 on a changing surface 140 coupled to the folding frame 110; step three 503, securing the baby 10 to the changing surface 140 using a fastener 146 located on the safety belt 144 step four 504, changing the baby 10, step five 505, collapsing the folding frame 110 (preferably in a vertical condition as shown in FIG. 4), and step six 506, storing the folding frame 110 and the changing surface 140.

It should be noted that step five 505 and step six 506 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a travel changer system 100, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A travel changer system comprising:

a folding frame comprising;

a pair of locking telescopic support cross beams having:

a first end a second end;

exactly four pivoting hinge members, each of said exactly four pivoting hinge members located at mid-point of each said pair of locking telescopic support cross beams;

exactly eight stabilizing locks, each of said exactly eight stabilizing locks located at said mid-point of each said pair of locking telescopic support cross beams;

a first-locking-changing surface support beam;

a second-locking-changing surface support beam;

a changing surface; and a safety belt having;

a fastener;

wherein said first end of said pair of locking telescopic support cross beams mechanically engage said first-locking-changing surface support beam and said second-locking-changing surface support beam;

wherein said second end of said pair of locking telescopic support cross beams is in contact with a planar surface during use;

wherein said first-locking-changing surface support beam and said second-locking-changing surface support beam are parallel to one another on opposing sides of said changing surface within a sleeve;

wherein said pair of locking telescopic support cross beams are located under said changing surface when configured to use;

wherein said pair of locking telescopic support cross beams are configured in an x-shape for folding and unfolding repeatedly;

wherein said pair of locking telescopic support cross beams are structured and arranged to be inserted from an outer perimeter of said changing surface, said first-locking-changing surface support beam, and said second-locking-changing surface support beam, and support the outer perimeter of said changing surface;

wherein said safety belt comprises and said fastener structured and arranged to secure a baby upon a top surface of said changing surface when used; and wherein said folding frame is structured and arranged to support the baby at a thigh height of a user during changing and further structured and arranged to collapse for storing.

2. The travel changer system of claim 1, wherein said first-locking-changing surface support beam and second-locking-changing surface support beam are rigid and comprise a folding member.

3. The travel changer system of claim 2, wherein said changing surface comprises said sleeve at a first-end and a second-end for coupling said changing surface to said first-locking-changing surface support beam and second-locking-changing surface support beam.

4. The travel changer system of claim 1, wherein said pair of locking telescopic support cross beams are positioned at opposing corners of said changing surface.

5. The travel changer system of claim 1, wherein said hinge member comprises a cross-beam pivoting hinge.

6. The travel changer system of claim 1, wherein said cross-beam pivoting hinge is configured to allow said pair of locking telescopic support cross beams to move in relation to one another from a folded configuration to said in-use condition.

7. The travel changer system of claim 1, wherein said first end of said pair of locking telescopic support cross beams are disposed inset to four corners of said changing surface.

8. The travel changer system of claim 1, wherein said first-locking-changing surface support beam and said second-locking-changing surface support beam are parallel and proximal to said outer perimeter of said changing surface further supporting a portion not supported by said locking telescopic support cross beams.

9. The travel changer system of claim 1, wherein said fastener comprises a buckle-strap-fastener.

10. The travel changer system of claim 9, wherein said buckle-strap-fastener comprises a quick release clasp and a strap clip fastener.

11. The travel changer system of claim 1, wherein said first-locking-changing surface support beam and second-locking-changing surface support beam are collapsible.

12. The travel changer system of claim 1, wherein said folding frame and said changing surface are configured to support said baby in an elevated position, said baby weighing up to approximately 30 pounds.

13. The travel changer system of claim 1, wherein said pair of locking telescopic support cross beams comprise a height approximately equal to said thigh height of said user.

14. The travel changer system of claim 1, further comprises a carrying case having a carry-handle.

15. The travel changer system of claim 1, wherein said changing surface comprises a substantially rectangular body.

16. The travel changer system of claim 15, wherein said changing surface comprises a flexible cloth canvas material.

17. A travel changer system comprising:

a folding frame comprising;

a pair of locking telescopic support cross beams having:

a first end a second end;

exactly four pivoting hinge members, each of said exactly four pivoting hinge members located at mid-point of each said pair of locking telescopic support cross beams;

exactly eight stabilizing locks, each of said exactly eight stabilizing locks located at said mid-point of each said pair of locking telescopic support cross beams;

a first-locking-changing surface support beam;

a second-locking-changing surface support beam;

a changing surface; and a safety belt having;

a fastener; and wherein said first end of said pair of locking telescopic support cross beams are structured and arranged to engage said first-locking-changing surface support beam and said second-locking-changing surface support beam;

wherein said first end of said pair of locking telescopic support cross beams are disposed inset to four corners of said changing surface;

wherein said changing surface comprises a substantially rectangular body;

wherein said changing surface comprises a flexible cloth canvas material;

wherein said first-locking-changing surface support beam and said second-locking-changing surface support beam are structured and arranged parallel and proximal to said outer perimeter of said changing surface further supporting a portion not supported by said pair of locking telescopic support cross beams;

wherein said second end of said pair of locking telescopic support cross beams is in contact with a planar surface during use;

wherein said first-locking-changing surface support beam and said second-locking-changing surface support beam are structured and arranged parallel to one another on opposing sides of said changing surface within a sleeve;

wherein said changing surface comprises said sleeve at a first-end and a second-end for coupling said changing surface to said first-locking-changing surface support beam and second-locking-changing surface support beam;

wherein said first-locking-changing surface support beam and second-locking-changing surface support beam are rigid and comprise a folding member;

wherein said first-locking-changing surface support beam and second-locking-changing surface support beam are collapsible;

wherein said pair of locking telescopic support cross beams are located under said changing surface when configured to use;

wherein said pair of locking telescopic support cross beams comprise hinge members and are configured in an x-shape for folding and unfolding repeatedly as desired at said hinge member;

wherein said pair of locking telescopic support cross beams comprise said hinge members in a middle section for folding;

wherein said hinge member comprises a cross-beam pivoting hinge;

wherein said cross-beam pivoting hinge is configured to allow said pair of locking telescopic support cross beams to move in relation to one another from a folded configuration to said in-use condition;

wherein said pair of locking telescopic support cross beams are inset from an outer perimeter of said changing surface, said first-locking-changing surface support beam and said second-locking-changing surface support beam further support the outer perimeter of said changing surface;

wherein said pair of locking telescopic support cross beams are positioned at opposing corners of said changing surface;

wherein said safety belt comprises said fastener which is configured to secure a baby upon a top surface of said changing surface when used;

wherein said fastener comprises a buckle-strap-fastener;

wherein said buckle-strap-fastener comprises a quick release clasp and a strap clip fastener;

wherein said folding frame and said changing surface are configured to support said baby in an elevated position, said baby weighing up to approximately 30 pounds;

wherein said pair of locking telescopic support cross beams comprise a height approximately equal to said thigh height of said user when extended;

wherein said travel changer system further comprises a carrying case having a carry-handle; and wherein said folding frame is configured to support said baby at a thigh height of a user during changing and collapse for storing.

18. The travel changer system of claim 17, is arranged as a kit comprising:

a folding frame;

a changing surface; and a carrying case.

19. A method of using the travel changer system of claim 17, the method comprising the steps of:

unfolding a folding frame;

placing a baby on a changing surface coupled to said folding frame;

securing said baby to said changing surface using fastener located on a safety belt; and changing said baby at a thigh-height.

20. The method of claim 19, further comprising the steps of:

collapsing said folding frame; and storing said folding frame and said changing surface.

* * * * *